US008366080B2

(12) United States Patent
Abe et al.

(10) Patent No.: US 8,366,080 B2
(45) Date of Patent: Feb. 5, 2013

(54) FUEL SUPPLY DEVICE FOR ENGINE

(75) Inventors: Hitoshi Abe, Wako (JP); Yukio Sugimoto, Wako (JP); Eiichi Utsugi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 382 days.

(21) Appl. No.: 12/922,206

(22) PCT Filed: Mar. 19, 2009

(86) PCT No.: PCT/JP2009/055397
§ 371 (c)(1),
(2), (4) Date: Sep. 22, 2010

(87) PCT Pub. No.: WO2009/119429
PCT Pub. Date: Oct. 1, 2009

(65) Prior Publication Data

US 2011/0006446 A1 Jan. 13, 2011

(30) Foreign Application Priority Data

Mar. 25, 2008 (JP) ..... 2008-078894
Mar. 25, 2008 (JP) ..... 2008-079174

(51) Int. Cl.
*F02M 7/08* (2006.01)

(52) U.S. Cl. ..... 261/34.2; 261/35; 261/69.1; 261/144; 261/DIG. 68

(58) Field of Classification Search ..... 261/34.2, 261/35, 69.1, 143–145, DIG. 20, DIG. 68
See application file for complete search history.

(56) References Cited

U.S. PATENT DOCUMENTS

| | | | | |
|---|---|---|---|---|
| 2,551,719 | A | | 5/1951 | Ball |
| 3,807,371 | A | * | 4/1974 | Nutten et al. ..... 123/330 |
| 3,920,776 | A | * | 11/1975 | Wildt-Persson et al. ..... 261/35 |
| 3,992,490 | A | * | 11/1976 | Preston ..... 261/41.5 |
| 4,936,267 | A | * | 6/1990 | Gerhardy et al. ..... 123/179.16 |
| 5,176,855 | A | * | 1/1993 | Jones ..... 261/39.3 |
| 5,241,931 | A | * | 9/1993 | Radel ..... 123/179.14 |
| 5,545,357 | A | * | 8/1996 | Radel et al. ..... 261/35 |
| 5,743,240 | A | * | 4/1998 | Zerrer et al. ..... 123/518 |
| 6,439,546 | B1 | * | 8/2002 | Galka ..... 261/4 |
| 6,481,699 | B1 | * | 11/2002 | Aihara et al. ..... 261/34.2 |

(Continued)

FOREIGN PATENT DOCUMENTS

| | | | |
|---|---|---|---|
| JP | 55-156238 | A * | 12/1980 |
| JP | 2007-027707 | A | 1/2000 |

(Continued)

*Primary Examiner* — Richard L Chiesa
(74) *Attorney, Agent, or Firm* — Carrier Blackman & Associates, P.C.; Joseph P. Carrier; William D. Blackman

(57) ABSTRACT

Disclosed is an engine fuel supply apparatus which can be made smaller in size and in which the amount of fuel in an air-fuel mixture can be increased with a fast response in correspondence with the operation of a throttle valve when the engine is accelerated rapidly. The fuel supply apparatus is provided with a fuel booster pump. A portion of an air-fuel mixture is introduced into a negative-pressure chamber of the fuel booster pump via a negative-pressure chamber channel, and the fuel booster pump is actuated. The actuation forces air in a pump chamber to flow into a pressure chamber, and fuel in a fuel storage chamber is temporarily supplied to a carburetor.

3 Claims, 9 Drawing Sheets

U.S. PATENT DOCUMENTS

| | | | | |
|---|---|---|---|---|
| 6,622,992 | B2 * | 9/2003 | Woody | 261/35 |
| 6,913,250 | B2 * | 7/2005 | Osburg et al. | 261/35 |
| 6,928,996 | B2 * | 8/2005 | Tobinai | 123/586 |
| 2004/0070088 | A1 * | 4/2004 | Osburg et al. | 261/35 |
| 2007/0013085 | A1 * | 1/2007 | Araki | 261/35 |
| 2008/0061454 | A1 * | 3/2008 | Braun | 261/35 |
| 2010/0193166 | A1 | 8/2010 | Ono | |

FOREIGN PATENT DOCUMENTS

| | | | |
|---|---|---|---|
| JP | 2000-257508 | A | 9/2000 |
| JP | 2007-071054 | A | 3/2007 |
| JP | 2008-063983 | A | 3/2008 |
| WO | 2008/029875 | A1 | 3/2008 |

* cited by examiner 10
63
18
52
16
33
57
6
57a
24
23
6
11
29
21
63
22
18
11a
47

FUEL SUPPLY DEVICE FOR ENGINE

This application is a national stage of International Application No. PCT/JP2009/055397, filed on Mar. 19, 2009.

TECHNICAL FIELD

The present invention relates to an engine fuel supply apparatus provided with a fuel booster pump for increasing the amount of fuel fed to a carburetor.

BACKGROUND ART

An engine fuel supply apparatus mixes fuel with air in a carburetor and supplies the resulting air-fuel mixture from the carburetor into a cylinder.

It is believed that when an engine is rapidly accelerated from idling (when the engine speed is rapidly increased), the supply of fuel is delayed due to a sudden change in the amount of air flow, the air-fuel mixture is temporarily diluted, and the engine is inadequately accelerated or stopped.

An engine fuel supply apparatus having an insulator provided between the engine and the carburetor to prevent engine heat from being transmitted to the carburetor, and also having a fuel booster pump provided to the insulator is known as a measure against the above-described problem, as is disclosed in JP 2007-071054 A (Patent Document 1). Providing a fuel booster pump allows the amount of fuel in the air-fuel mixture to be temporarily increased during engine acceleration.

The engine fuel supply apparatus of Patent Document 1 has an air-fuel mixture supply channel provided in the lower half of the insulator, an air channel provided in the upper half, and a fuel booster pump provided in the bottom part of the insulator. The air channel is communicated with a negative-pressure chamber of the fuel booster pump via an air introduction channel.

In this engine fuel supply apparatus, the air introduction channel is kept under negative pressure during idling because the throttle angle is small. The air introduction channel kept under negative pressure creates negative pressure in the negative-pressure chamber of the fuel booster pump. The negative-pressure diaphragm of the fuel booster pump is thereby moved toward the negative-pressure chamber by the elastic force of a spring member.

When the angle of a throttle valve is increased from this state and the vehicle is rapidly accelerated, air is fed to the air introduction channel and the negative-pressure chamber of the fuel booster pump. The negative-pressure diaphragm of the fuel booster pump acts against the elastic force of the spring member and moves instantaneously toward the pump chamber. Air in the pump chamber is forced out to a pressure chamber via a communicating channel.

The pressure diaphragm is pushed out toward the fuel chamber, and the fuel in the fuel chamber is supplied to the air-fuel mixture supply channel in a temporarily increased amount. The amount of fuel in the air-fuel mixture is thereby temporarily increased with a fast response in correspondence with an operation of the throttle valve when the engine is rapidly accelerated from idling.

In the fuel supply apparatus of Patent Document 1, however, an air channel must be provided to the upper half of the insulator in order to provide a fuel booster pump to the insulator. In other words, two channels (the air-fuel mixture supply channel and the air channel) must be provided to the insulator in the fuel supply apparatus, making it difficult to keep the device compact.

Further, because an air channel is provided to the upper half of the insulator, and a fuel booster pump is provided to the lower half of the insulator, an air-fuel mixture supply channel is provided between the air channel and the fuel booster pump. The air introduction channel for providing communication between the air channel and the fuel booster pump must therefore bypass the air-fuel mixture supply channel, the air introduction channel has a complex shape, and the overall length dimension is increased. The complex shape and increased overall length dimension of the air introduction channel sometimes delays the timing with which the air is fed to the negative-pressure chamber via the air introduction channel. For this reason, boosting and drawing the fuel from the fuel chamber with a fast response in correspondence with an operation of the throttle valve is difficult.

DISCLOSURE OF THE INVENTION

It is therefore an object of the present invention to provide an engine fuel supply apparatus which can be made smaller in size and in which the amount of fuel in an air-fuel mixture can be increased with a fast response in correspondence with the operation of a throttle valve when the engine is accelerated rapidly.

According to a first aspect of the present invention, there is provided a fuel supply apparatus for an engine, having a carburetor provided with a pressure diaphragm partitioning a fuel chamber and a pressure chamber, for increasing an amount of fuel drawn from the fuel chamber by applying pressure to the pressure chamber, which engine fuel supply apparatus comprises: an insulator interposed between the carburetor and the engine, the insulator acting to block off heat from the engine and having an air-fuel mixture supply channel for feeding the air-fuel mixture mixed with the fuel in the carburetor to the engine; a fuel booster pump incorporated in the insulator, the fuel booster pump having a pump chamber for applying pressure to the pressure chamber, and a negative-pressure chamber disposed adjacent to the pump chamber via a negative-pressure diaphragm; a negative-pressure chamber channel formed in the insulator so as to provide communication between the negative-pressure chamber and the air-fuel mixture supply channel, the negative-pressure chamber channel introducing a portion of the air-fuel mixture from the air-fuel mixture supply channel into the negative-pressure chamber; and a pump chamber channel formed in the body of the carburetor so as to provide communication between the pump chamber and the pressure chamber, the pump chamber channel introducing air from the pump chamber into the pressure chamber.

In the present invention, a portion of the air-fuel mixture is thus introduced into the negative-pressure chamber via a negative-pressure channel. When the throttle angle is increased from idling and the vehicle is rapidly accelerated (when the engine speed is rapidly increased), a large amount of air is thereby instantaneously fed to the carburetor. The fuel is mixed with the large amount of air and forms an air-fuel mixture. The air-fuel mixture is instantaneously fed to the air-fuel mixture supply channel.

A portion of the large amount of air-fuel mixture is instantaneously fed to the negative-pressure chamber of the fuel booster pump via the negative-pressure chamber channel, and the fuel booster pump is actuated. The actuation of the fuel booster pump forces the air in the pump chamber to flow into the pressure chamber, and the fuel in the fuel chamber is supplied to the carburetor in a temporarily increased amount.

The content of fuel in the air-fuel mixture can thereby be temporarily increased and the engine can be prevented from being inadequately accelerated or stopped.

By introducing a portion of the air-fuel mixture into the negative-pressure chamber via the negative-pressure channel, the air-fuel mixture in the air-fuel mixture supply channel can be used to actuate the fuel booster pump. The need is thereby eliminated to provide the insulator with an air channel in the same manner as in the prior art in order to actuate the fuel booster pump, and the device can therefore be made smaller in size.

Because there is no need to provide the insulator with an air channel, the negative-pressure chamber channel can be positioned close to the air-fuel mixture supply channel. The shape of the negative-pressure chamber channel can thereby be simplified and the overall length dimension can be kept small. The air-fuel mixture can thereby be smoothly and rapidly introduced into the negative-pressure chamber via the negative-pressure chamber channel, and well-timed feeding of the air-fuel mixture into the negative-pressure chamber is therefore assured. Therefore, the amount of fuel in the fuel chamber can be rapidly increased and drawn out with a fast response in correspondence with the operation of the throttle valve.

Preferably, the fuel booster pump is disposed above the air-fuel mixture supply channel, and the negative-pressure chamber channel is extended upwards toward the negative-pressure chamber from the air-fuel mixture supply channel.

As stated earlier, when the throttle angle is increased for rapid acceleration, the air-fuel mixture is fed to the negative-pressure chamber of the fuel booster pump. For this reason, it is believed that the fuel contained in the air-fuel mixture accumulates in the negative-pressure chamber of the fuel booster pump, and variations occur in the air-fuel ratio of the air-fuel mixture supplied to the engine from the carburetor. The variations in the air-fuel ratio of the air-fuel mixture make it difficult to drive the engine smoothly.

In view of this, the negative-pressure chamber channel is extended upwards toward the negative-pressure chamber from the air-fuel mixture supply channel. Atomized fuel can thereby be returned to the air-fuel mixture supply channel via the negative-pressure chamber channel when the fuel is fed to the negative-pressure chamber and is caused to drip in the bottom part of the negative-pressure chamber. Variations in the air-fuel ratio of the air-fuel mixture can thereby be suppressed and the engine can be driven smoothly.

According to another aspect of the present invention, there is provided a fuel supply apparatus for an engine, having a carburetor provided with a pressure diaphragm partitioning a fuel chamber and a pressure chamber, for increasing an amount of fuel drawn from the fuel chamber by applying pressure to the pressure chamber, which engine fuel supply apparatus comprises: an insulator interposed between the carburetor and the engine, the insulator acting to block off heat from the engine and having an air-fuel mixture supply channel for feeding the air-fuel mixture mixed with the fuel in the carburetor to the engine; a fuel booster pump incorporated in the insulator and disposed above the air-fuel mixture supply channel, the fuel booster pump having a pump chamber for applying pressure to the pressure chamber, and a negative-pressure chamber disposed adjacent to the pump chamber via a negative-pressure diaphragm; and a channel extending downwards toward the air-fuel mixture supply channel from the bottom part of the negative-pressure chamber, the channel introducing a portion of the air-fuel mixture from the air-fuel mixture supply channel into the negative-pressure chamber.

In the other aspect of the present invention, a portion of the air-fuel mixture is thus introduced into the negative-pressure chamber from the air-fuel mixture supply channel via the channel. When the throttle angle is increased from idling and the vehicle is rapidly accelerated (when the engine speed is rapidly increased), a large amount of air is instantaneously fed to the carburetor. The fuel is mixed with the large amount of air to form an air-fuel mixture. The air-fuel mixture is instantaneously fed to the air-fuel mixture supply channel.

A portion of the air-fuel mixture fed in a large amount is instantaneously fed to the negative-pressure chamber of the fuel booster pump via the negative-pressure chamber channel, and the fuel booster pump is actuated. The actuation of the fuel booster pump forces the air in the pump chamber to flow into the pressure chamber, and the fuel from the fuel chamber is supplied to the carburetor in a temporarily increased amount. The content of fuel in the air-fuel mixture can thereby be temporarily increased in correspondence with the operation of the throttle valve, and the engine can be prevented from being inadequately accelerated or stopped.

On the other hand, the air-fuel mixture supply channel is kept under negative pressure when the throttle valve is maintained at a particular angle. Keeping the air-fuel mixture supply channel under negative-pressure establishes a negative pressure in the negative-pressure chamber of the fuel booster pump. Operation of the fuel booster pump is thereby stopped and the air in the pump chamber is no longer forced to the pressure chamber. The engine is thereby driven in a normal state in which the content of fuel in the air-fuel mixture is not temporarily increased.

As stated earlier, when the throttle angle is increased for rapid acceleration, the air-fuel mixture is introduced into the negative-pressure chamber of the fuel booster pump. For this reason, it is believed that the fuel contained in the air-fuel mixture accumulates in the negative-pressure chamber of the fuel booster pump, and variations occur in the air-fuel ratio of the air-fuel mixture supplied to the engine from the carburetor. The variations in the air-fuel ratio of the air-fuel mixture make it difficult to chive the engine smoothly.

In view of this, in another aspect of the present invention, the fuel booster pump is disposed above the air-fuel mixture supply channel and the channel is extended toward the air-fuel mixture supply channel from the bottom part of the negative-pressure chamber. Atomized fuel can thereby be returned to the air-fuel mixture supply channel via the channel when the fuel is fed to the negative-pressure chamber and caused to drip in the bottom part of the negative-pressure chamber. Variations in the air-fuel ratio of the air-fuel mixture can thereby be suppressed and the engine can be driven smoothly.

Furthermore, by introducing a portion of the air-fuel mixture through the air-fuel mixture supply channel into the negative-pressure chamber via the channel, it is possible to use the air-fuel mixture of the air-fuel mixture supply channel to actuate the fuel booster. The need is thereby eliminated to provide the insulator with an air channel in the same manner as in the prior art in order to actuate the fuel booster pump, and the device can therefore be made smaller in size.

BEST MODE FOR CARRYING OUT THE INVENTION

The preferred embodiments of the present invention will be described in detail below with reference to the accompanying drawings.

Figure 1:
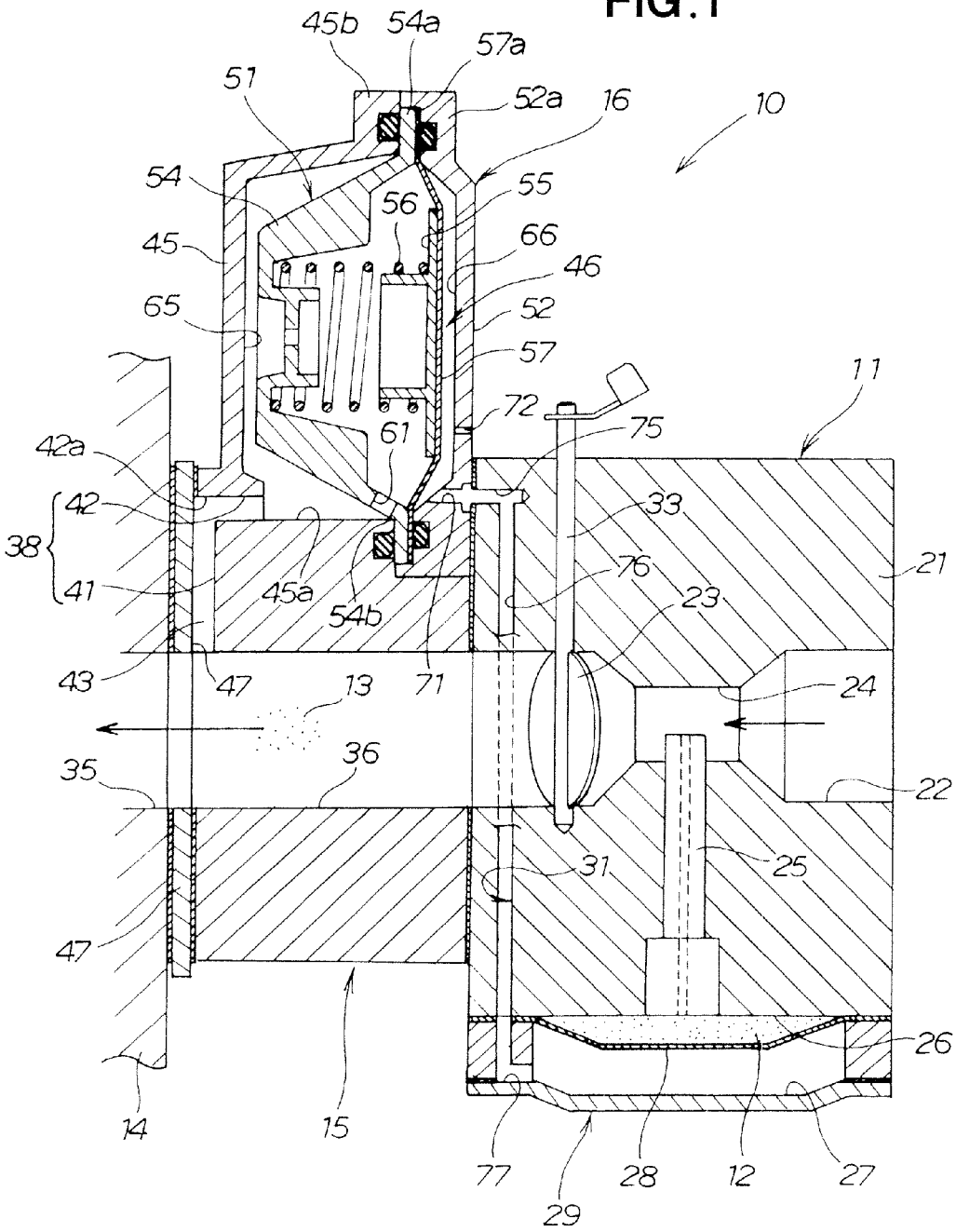
FIG. 1 is a cross-sectional view showing the principles of a fuel supply apparatus according to an embodiment of the present invention.

Referring to FIG. 1, the engine fuel supply apparatus 10 comprises a carburetor 11 for mixing fuel 12 with air, an insulator 15 interposed between the carburetor 11 and the engine 14, and a fuel booster pump 16 incorporated in the insulator 15. The carburetor 11 and the insulator 15 are mounted to the engine 14 by bolts 18, 18 (see FIGS. 2, 3.)

Figure 2:
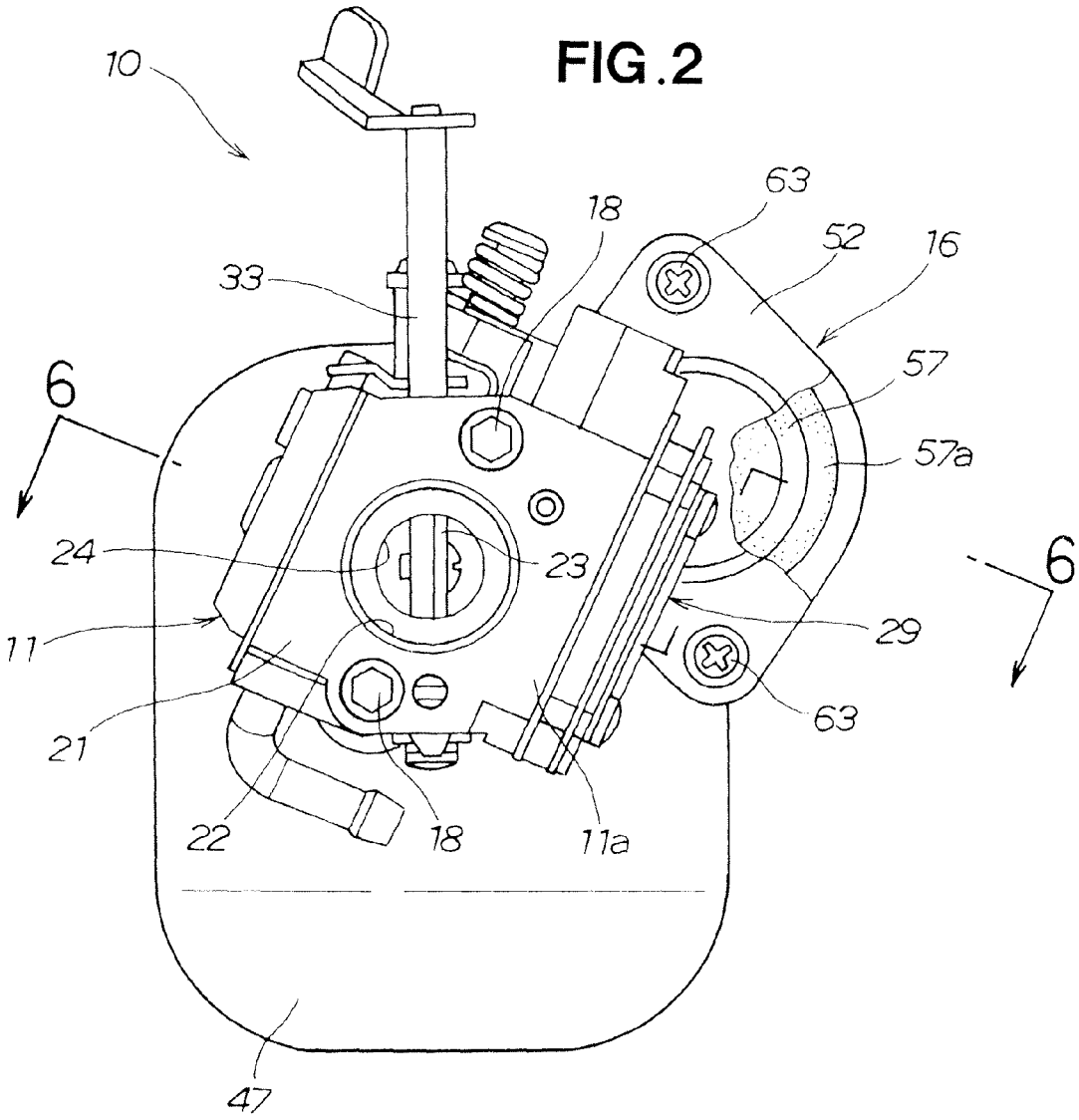
FIG. 2 is a side view showing a device of the fuel supply apparatus of FIG. 1.

As an example, a liquid fuel is used in the fuel supply apparatus 10. To facilitate understanding of the engine fuel supply apparatus 10, an example is described for convenience purposes in which the fuel booster pump 16 is disposed directly above the insulator 15, and a carburetor pump 29 is provided in the bottom part of the carburetor 11 in the principle view of FIG. 1. In the fuel supply apparatus 10 of the present embodiment, however, the carburetor pump 29 is provided to a side part 11*a* of the fuel booster pump 16 as a part of the carburetor 11, as shown in FIG. 2.

The carburetor 11 has a body 21 of the carburetor 11, an air-fuel mixture channel 22 formed in the body 21, a throttle valve 23 disposed in the air-fuel mixture channel 22, a fuel nozzle 25 whose distal part is positioned in a Venturi part 24 of the air-fuel mixture channel 22, a fuel storage chamber 26 communicated with the fuel nozzle 25, a pressure chamber 27 disposed adjacently to the fuel storage chamber 26, a pressure diaphragm 28 for partitioning the pressure chamber 27 and the fuel storage chamber 26, and a pump chamber channel 31 for communicating the pressure chamber 27 to the pump chamber 66.

The carburetor pump 29 is formed from the fuel storage chamber 26, the pressure chamber 27, and the pressure diaphragm 28. The fuel storage chamber 26 is communicated with the fuel tank (not shown) via a fuel supply channel (not shown). The pump chamber channel 31 will be described in detail in FIGS. 5 and 6.

In the above-described carburetor 11, operating the throttle valve 23 to adjust the opening of the air-fuel mixture channel 22 adjusts the amount of air which flows to the Venturi part 24 of the air-fuel mixture channel 22. Feeding the air to the Venturi part 24 as shown by the arrows causes the fuel 12 to be fed to the Venturi part 24 through the fuel nozzle 25.

By applying pressure to the pressure chamber 27 to push the pressure diaphragm 28 toward the fuel storage chamber 26, the fuel 12 is forcibly ejected from the fuel nozzle 25 to the Venturi part 24. Forcibly ejecting the fuel 12 to the Venturi part 24 allows the amount of fuel introduced into the Venturi part 24 to be increased.

Next, the actual positions of the fuel booster pump 16 and the carburetor pump 29 are described with reference to FIG. 2.

In the carburetor 11, a spindle 33 of the throttle valve 23 is mounted so as to be disposed vertically. The carburetor 11 is provided with the fuel booster pump 16 via the insulator 15 (FIG. 1).

The fuel booster pump 16 is disposed above and to the side of the air-fuel mixture channel 22 of the carburetor 11, that is, offset toward the side part 11*a*. Specifically, as shown in FIG. 4, the center 32 of the fuel booster pump 16 is placed above and to the side of the center 34 of the air-fuel mixture supply channel 36, that is, is offset toward the side part 11*a*.

Further, the carburetor pump 29 is provided to the side part 11*a* of the fuel booster pump 16. Providing the carburetor pump 29 to the side part 11*a* of the fuel booster pump 16 allows the carburetor pump 29 to be disposed near the fuel booster pump 16.

Returning to FIG. 1, the insulator 15 is interposed between the carburetor 11 and the engine 14 to block off heat from the engine 14. The insulator 15 comprises the air-fuel mixture supply channel 36 for providing communication between the air-fuel mixture channel 22 and an intake passage 35, and a negative-pressure chamber channel 38 for communicating the air-fuel mixture supply channel 36 to the negative-pressure chamber 65. As will be stated later, the negative-pressure chamber 65 is formed from a housing component 45 and a negative-pressure diaphragm 57. The intake passage 35 is a channel formed in the engine 14 and communicated with a cylinder (not shown). The air-fuel mixture supply channel 36 is a channel for feeding the air-fuel mixture 13 mixed with the liquid fuel 12 in the air-fuel mixture channel 22 to the intake passage 35.

Figure 3:
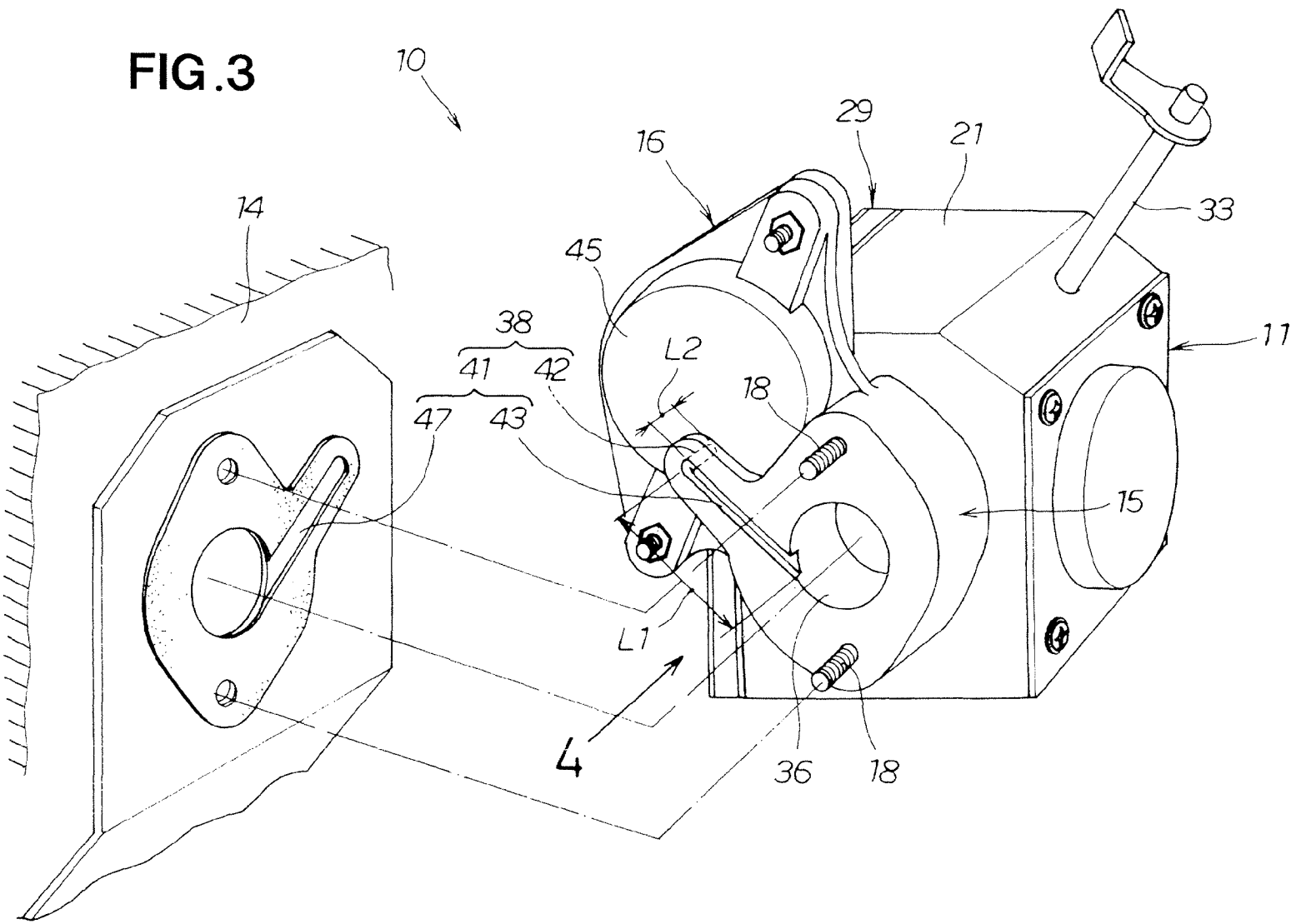
FIG. 3 is a perspective view showing the fuel supply apparatus of FIG. 2, with a plate disassembled from an insulator of the fuel supply apparatus.
Figure 4:
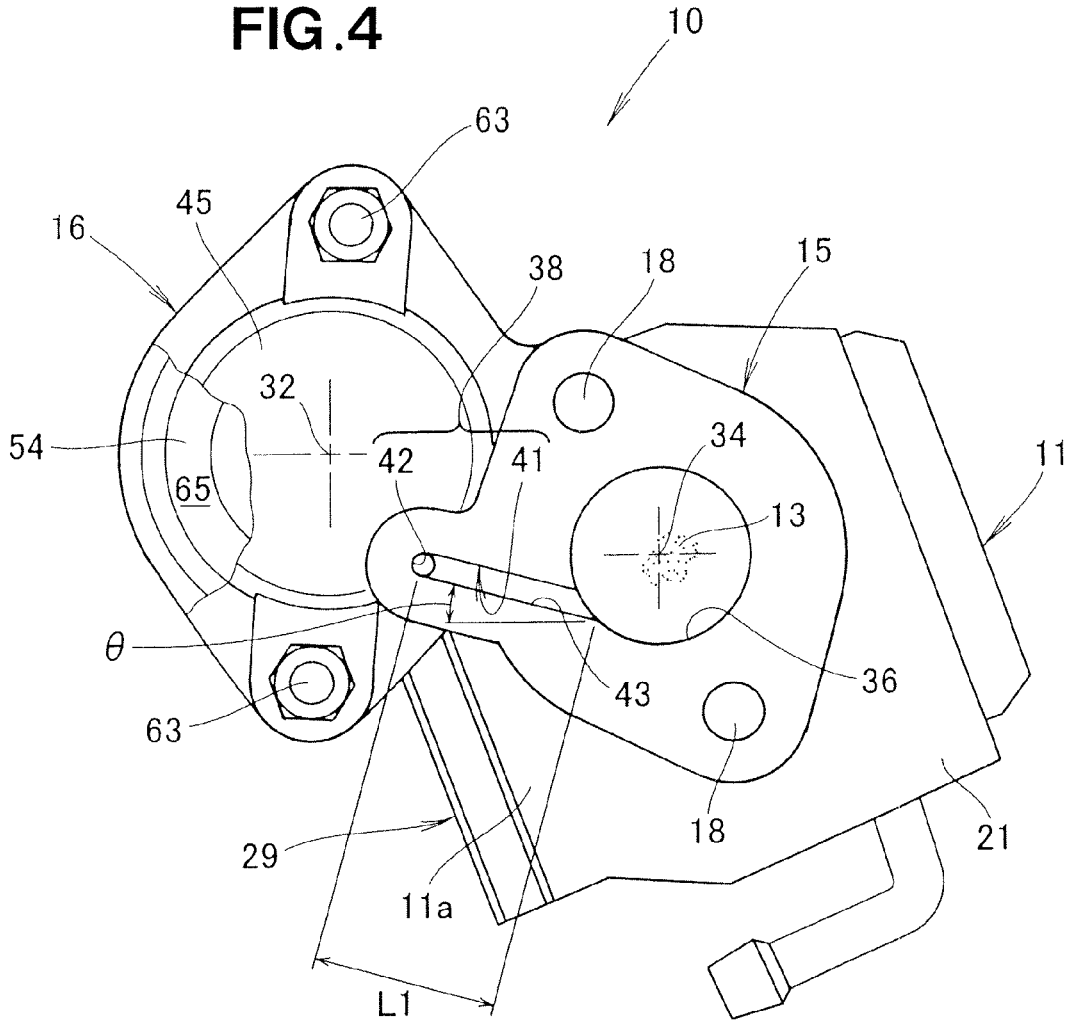
FIG. 4 is a view taken in a direction of arrow 4 of FIG. 3.

As shown in FIGS. 3 and 4, the negative-pressure chamber channel 38 comprises a channel groove 43 of a first negative-pressure chamber channel 41 and a second negative-pressure chamber channel 42, which are integrally formed in the insulator 15 so as to provide communication between the negative-pressure chamber 65 (see also FIG. 1) and the fir-fuel mixture supply channel 36.

The first negative-pressure chamber channel 41 is a channel formed by forming the channel groove 43 substantially perpendicularly to the air-fuel mixture supply channel 36 and sealing off the channel groove 43 with a plate 47. The first negative-pressure chamber channel 41 is a channel for providing communication between the second negative-pressure chamber channel 42 and the air-fuel mixture supply channel 36. As shown in FIG. 1, the plate 47 is a plate interposed between the insulator 15 and the engine 14.

The second negative-pressure chamber channel 42 is formed substantially parallel to the air-fuel mixture supply channel 36 and is communicated with a bottom part 45*a* (see FIG. 1) of the housing component 45 provided to the insulator 15. The bottom part 45*a* of the housing component 45 also constitutes the bottom part of the negative-pressure chamber 65.

As shown in FIG. 4, the first negative-pressure chamber channel 41 extends linearly downwards with a falling gradient of inclination angle θ from an end 42*a* (FIG. 1) of the second negative-pressure chamber channel 42 toward the air-fuel mixture supply channel 36. In other words, the first negative-pressure chamber channel 41 extends linearly upward with a rising gradient of inclination angle θ from the air-fuel mixture supply channel 36 toward the end 42*a* of the second negative-pressure chamber channel 42. The reason that the first negative-pressure chamber channel 41 is formed at an inclination angle θ will be described later.

The negative-pressure chamber 65 and the air-fuel mixture supply channel 36 are communicated by the negative-pressure chamber channel 38 constituted from the first and second negative-pressure chamber channels 41 and 42. Communicating the negative-pressure chamber 65 and the air-fuel mixture supply channel 36 by the negative-pressure chamber channel 38 allows a portion of the air-fuel mixture 13 to be introduced into the negative-pressure chamber 65 from the air-fuel mixture supply channel 36. By introducing a portion of the air-fuel mixture 13 into the negative-pressure chamber 65 via the negative-pressure chamber channel 38, the fuel booster pump 16 can be actuated using the air-fuel mixture 13 from the air-fuel mixture supply channel 36. The need is thereby eliminated to provide the insulator 15 with an air channel in the same manner as in the prior art in order to actuate the fuel booster pump 16, and the device can therefore be made smaller in size.

Furthermore, because there is no need to provide the insulator 15 with an air channel, the negative-pressure chamber channel 38 can be provided close to the air-fuel mixture supply channel 36. The negative-pressure chamber channel 38 can thereby be provided with a simpler linear shape, and the overall length (L1+L2) dimension can be made smaller. L2 is shown in FIG. 3. The air-fuel mixture 13 can thereby be fed smoothly and rapidly into the negative-pressure chamber 65 via the negative-pressure chamber channel 38, and well-timed feeding of the air-fuel mixture 13 into the negative-pressure chamber 65 is therefore assured. Therefore, the amount of fuel 12 from the fuel storage chamber 26 can be increased with a fast response and ejected in correspondence with the operation of the throttle valve 23 shown in FIG. 1.

Returning again to FIG. 1, the fuel booster pump 16 is disposed above the air-fuel mixture supply channel 36 and is incorporated in the insulator 15. Specifically, the fuel booster pump 16 is disposed above and to the side of the air-fuel mixture channel 22 of the carburetor 11 and the air-fuel mixture supply channel 36, as shown in FIGS. 2 and 4.

The fuel booster pump 16 is provided with a housing component 45 integrally formed with the insulator 15, a pump body 51 housed inside the housing component 45, and a lid 52 for holding the pump body 51 in the housing component 45.

In the housing component 45, the bottom part 45*a* is formed substantially horizontally, and the pump body 51 is housed inside the housing component 45. In the pump body 51, a compression spring 56 is interposed between a support member 54 and a moving member 55, and the moving member 55 is pushed to the negative-pressure diaphragm 57 by the elastic force of the compression spring 56.

A flange unit 57*a* of the negative-pressure diaphragm 57 and a flange unit 54*a* of the support member 54 are held in place by an outer rim 45*b* of the housing component 45 and an outer rim 52*a* of the lid 52. An exhaust port 61 is formed in the bottom part 54*b* of the support member 54. The exhaust port 61 opens to the bottom part 45*a* of the housing component 45. The lid 52 is mounted to the outer rim 45*b* of the housing component 45 by screws 63, 63 (see FIGS. 2 and 4.)

The negative-pressure chamber 65 is configured from the housing component 45 and the negative-pressure diaphragm 57. The negative-pressure chamber 65 is disposed adjacently to the pump chamber 66 via the negative-pressure diaphragm 57. The pump chamber 66 is configured from the negative-pressure diaphragm 57 and the lid 52. A space 46 in the pump chamber 66 is reduced by moving the negative-pressure diaphragm 57 toward the lid 52. Reducing the space 46 in the pump chamber 66 causes the air in the pump chamber 66 to be fed to the pressure chamber 27 via the pump chamber channel 31, and the interior of the pressure chamber 27 to be pressurized.

The lid 52 has a pressure port 71 communicated with the pump chamber 66, and an atmosphere release port 72 that is open to the atmosphere. The pressure port 71 is communicated with the pressure chamber 27 via the pump chamber channel 31. The atmosphere release port 72 communicates the pump chamber 66 to the atmosphere.

Figure 5:
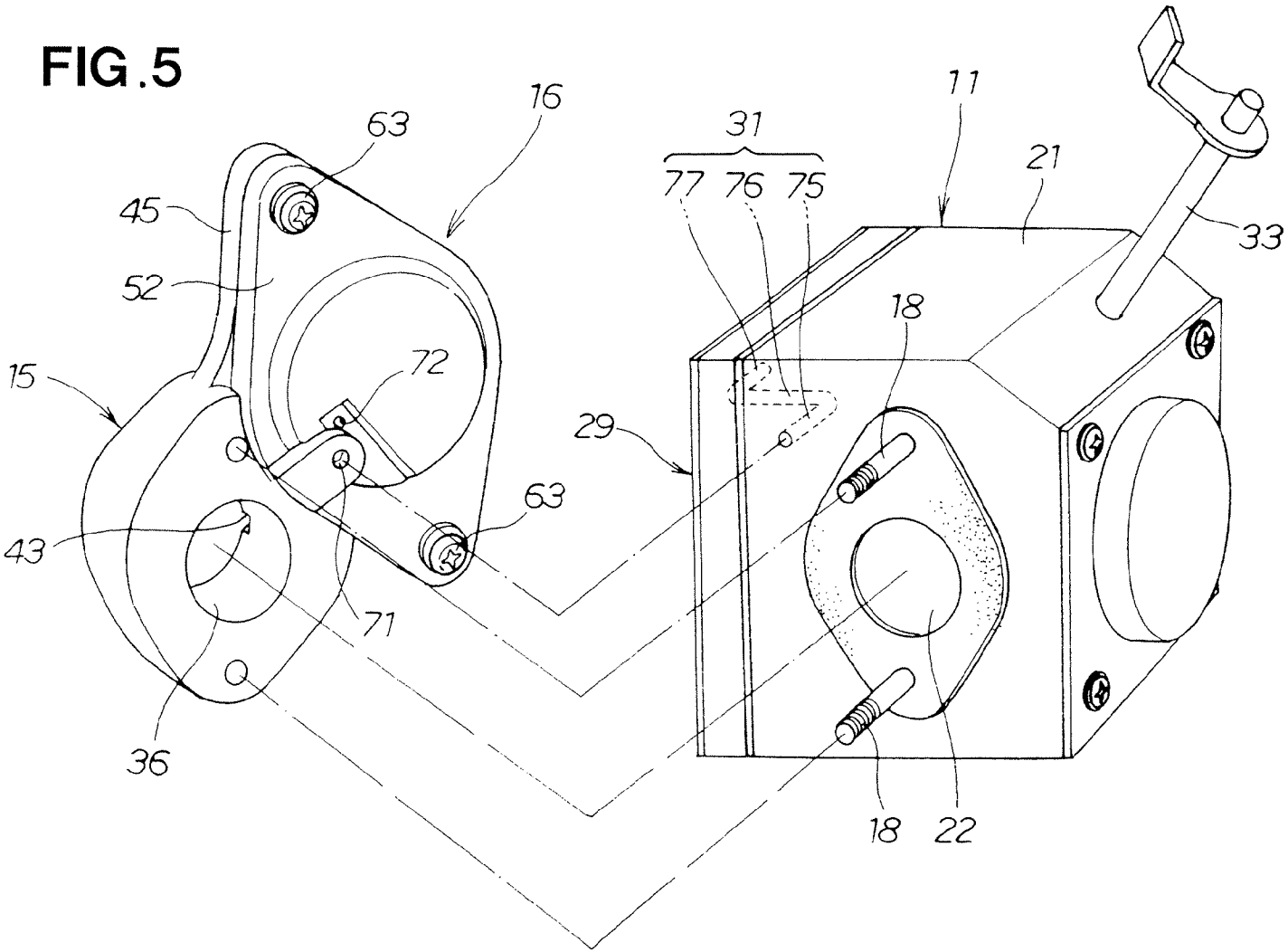
FIG. 5 is a perspective view showing the insulator disassembled from the apparatus of FIG. 3.
Figure 6:
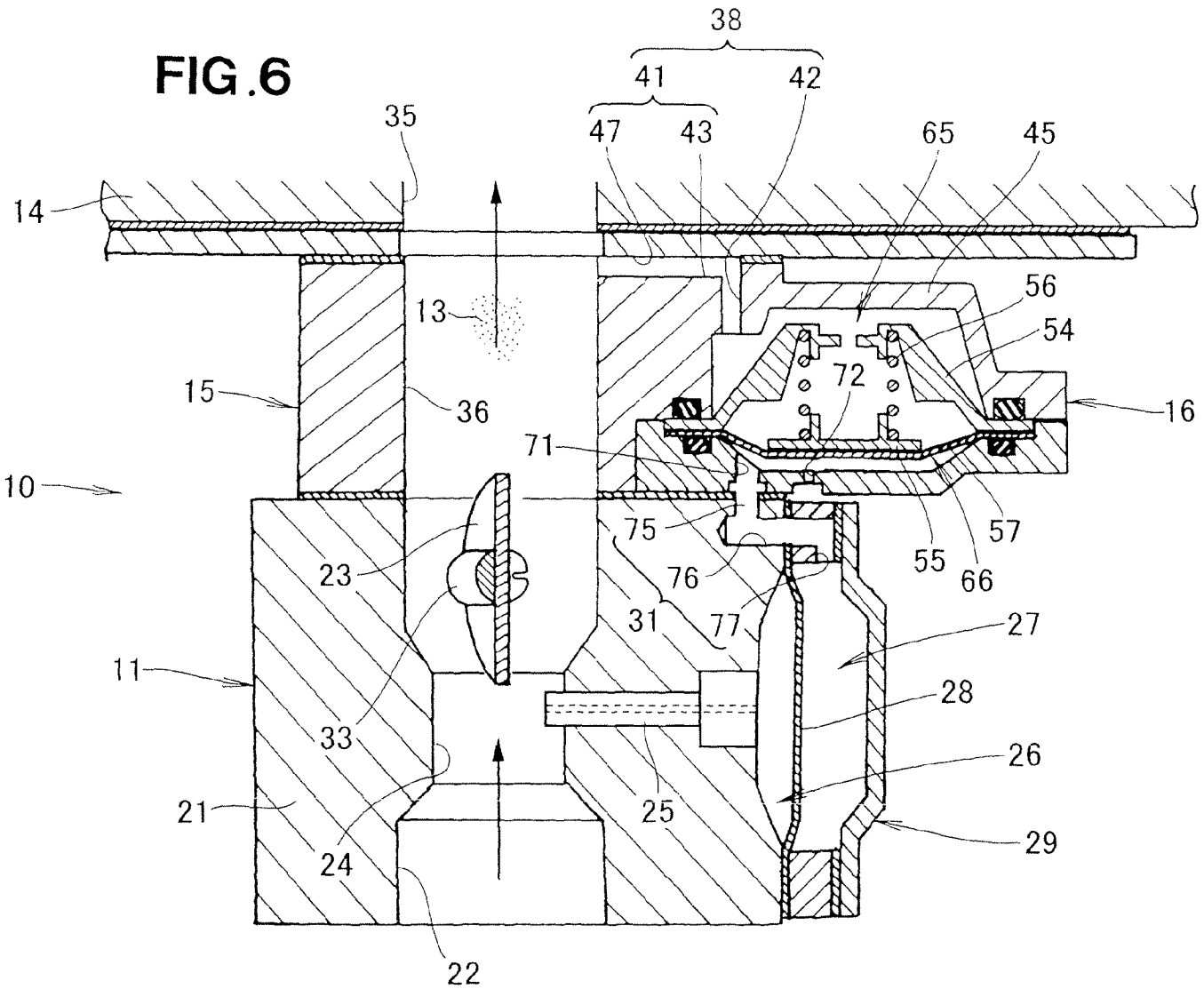
FIG. 6 is a cross-sectional view taken along line 6-6 of FIG. 2.

Referring to FIGS. 5 and 6, the pump chamber channel 31 described above is provided with a first, second, and third pump chamber channels 75, 76, and 77 sequentially formed in the body 21 so as to provide communication between the pump chamber 66 and the pressure chamber 27.

The first pump chamber channel 75 is formed substantially parallel to the air-fuel mixture channel 22 and is communicated with the pressure port 71 of the lid 52. The second pump chamber channel 76 is formed so as to intersect substantially at a right angle to the air-fuel mixture channel 22 from an end of the first pump chamber channel 75 toward the carburetor pump 29. The third pump chamber channel 77 is formed substantially parallel to the air-fuel mixture channel 22 from an end of the second pump chamber channel 76 to the pressure chamber 27.

By communicating the first pump chamber channel 75 with the pressure port 71 and communicating the third pump chamber channel 77 with the pressure chamber 27, the pump chamber 66 and the pressure chamber 27 are communicated by the pump chamber channel 31 and the pressure port 71. Air from the pump chamber 66 is thereby introduced into the pressure chamber 27 via the pressure port 71 and the pump chamber channel 31.

Forming the pump chamber channel 31 in the body 21 dispenses with the need to provide a pump chamber channel 31 by using a separate member (e.g., a hose or a tube). The number of parts can thereby be reduced, the construction is simplified, and man-hours of assembly can be reduced.

Furthermore, as shown in FIG. 2, the carburetor pump 29 is disposed in the side part 11*a* near the fuel booster pump 16 as a part of the carburetor 11. The pressure port 71 of the carburetor pump 29 can thereby be placed near the fuel booster pump 16. The shape of the pump chamber channel 31 can thereby be simplified, the overall length dimension can be kept small, and the air in the pump chamber 66 can be sent out rapidly to the pressure chamber 27.

Next, the action of the engine fuel supply apparatus 10 will be described with reference to the principle views of FIGS. 7 to 9. First, the operation of the engine fuel supply apparatus 10 in a state in which the vehicle is rapidly accelerated from idling is described with reference to the principle views of FIGS. 7 and 8.

Figure 7:
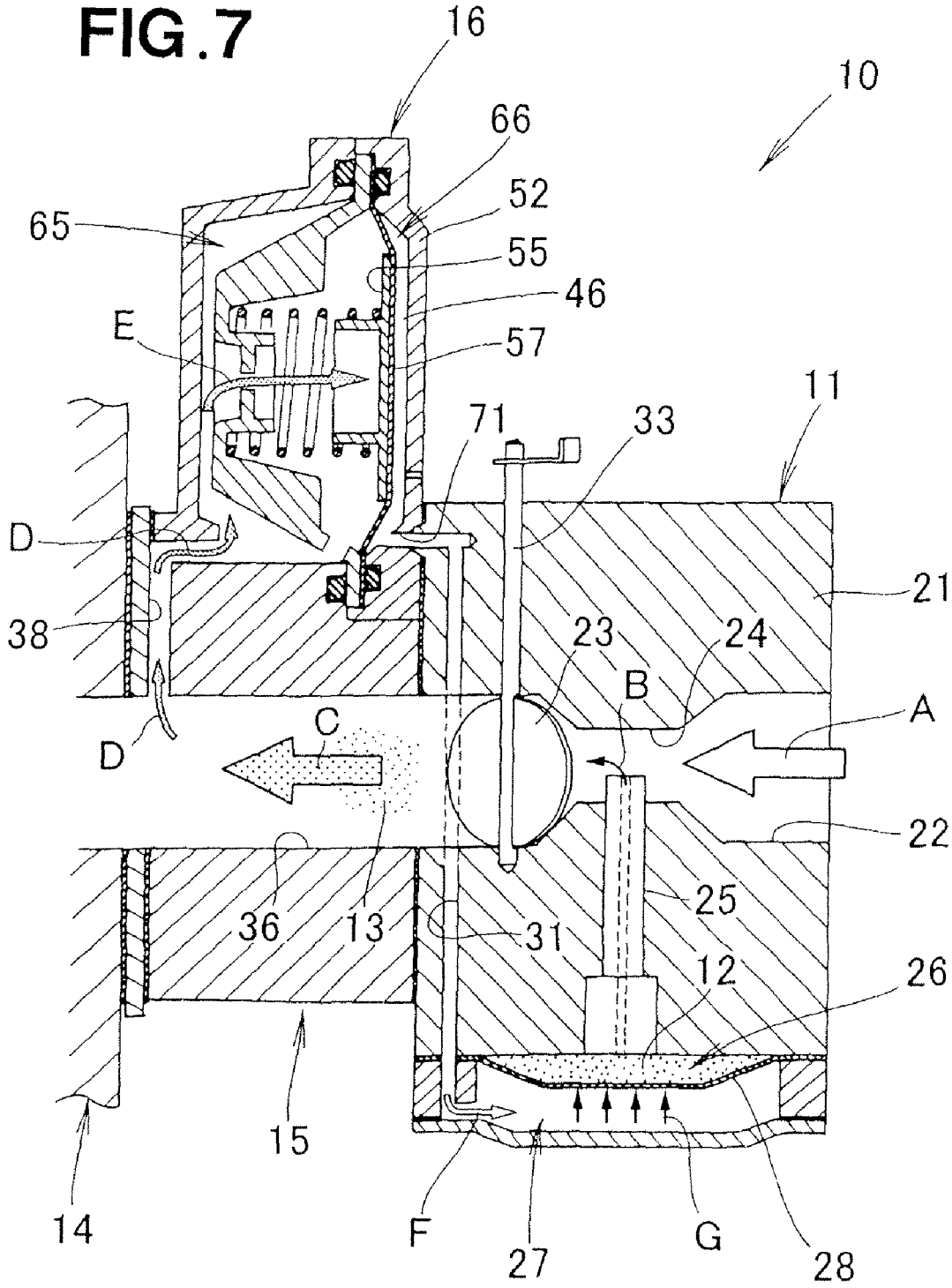
FIG. 7 is a view showing an example operation of the fuel supply apparatus according to the present invention as the vehicle is rapidly accelerated from idling.

As shown in FIG. 7, the angle of the throttle valve 23 is increased and the engine 14 is rapidly accelerated from idling. A large amount of air is instantaneously fed to the air-fuel mixture channel 22 of the carburetor 11, as shown by arrow A.

The fuel 12 from the fuel storage chamber 26 is supplied via the fuel nozzle 25 to the Venturi part 24, as shown by arrow B. The fuel 12 is mixed with a large amount of air to form an air-fuel mixture 13. The air-fuel mixture 13 is instantaneously fed to the air-fuel mixture supply channel 36, as shown by arrow C.

A portion of the large amount of air-fuel mixture 13 is instantaneously fed to the negative-pressure chamber 65 of the fuel booster pump 16 via the negative-pressure chamber channel 38, as shown by arrow D. The negative-pressure chamber channel 38 extends upward from the air-fuel mixture supply channel 36 toward the negative-pressure chamber 65.

Specifically, as shown in FIG. 4, the first negative-pressure chamber channel 41 of the negative-pressure chamber channel 38 extends linearly upward at an inclination angle θ from the air-fuel mixture supply channel 36 toward the negative-pressure chamber 65. Linearly extending the negative-pressure chamber channel 38 (specifically, the first negative-pressure chamber channel 41) allows the air-fuel mixture 13 to flow smoothly down the negative-pressure chamber channel 38. The air-fuel mixture 13 can thereby be fed rapidly from the negative-pressure chamber channel 38 to the negative-pressure chamber 65.

The large amount of air-fuel mixture 13 instantaneously fed to the negative-pressure chamber 65 applies pressure to the moving member 55, as shown by arrow E. The negative-pressure diaphragm 57 moves toward the lid 52, and the space 46 of the pump chamber 66 is reduced. Reducing the space 46 of the pump chamber 66 causes the air inside the pump chamber 66 to be pushed out into the pressure chamber 27 via the pressure port 71 and the pump chamber channel 31, as shown by arrow F. Pushing out the air into the pressure chamber 27 causes the pressure chamber 27 to be pressurized and the pressure diaphragm 28 to move toward the fuel storage chamber 26, as shown by arrow G.

Figure 8:
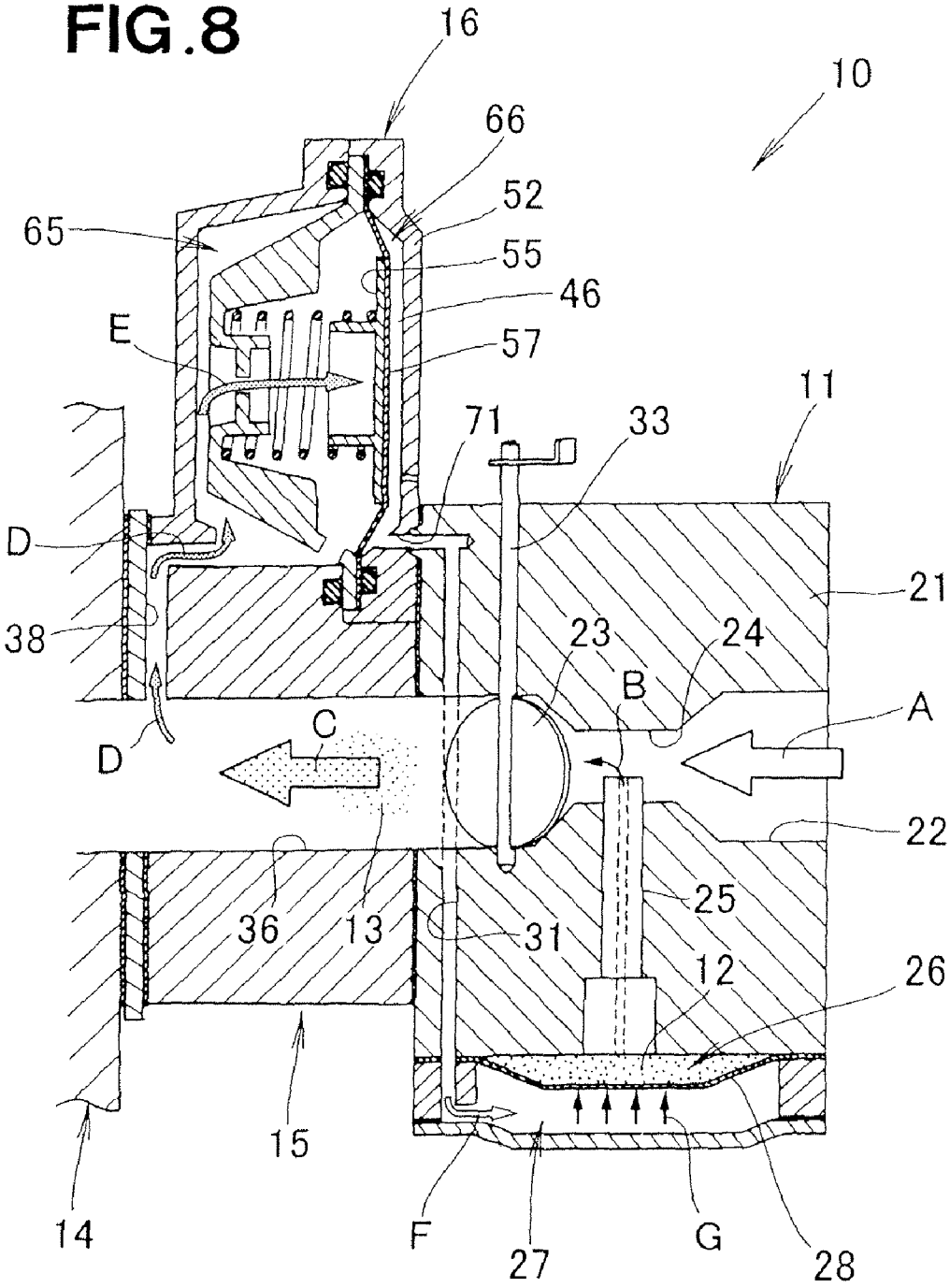
FIG. 8 is a view showing an example of temporarily increasing the amount of fuel with the fuel supply apparatus of the present invention.
Figure 9:
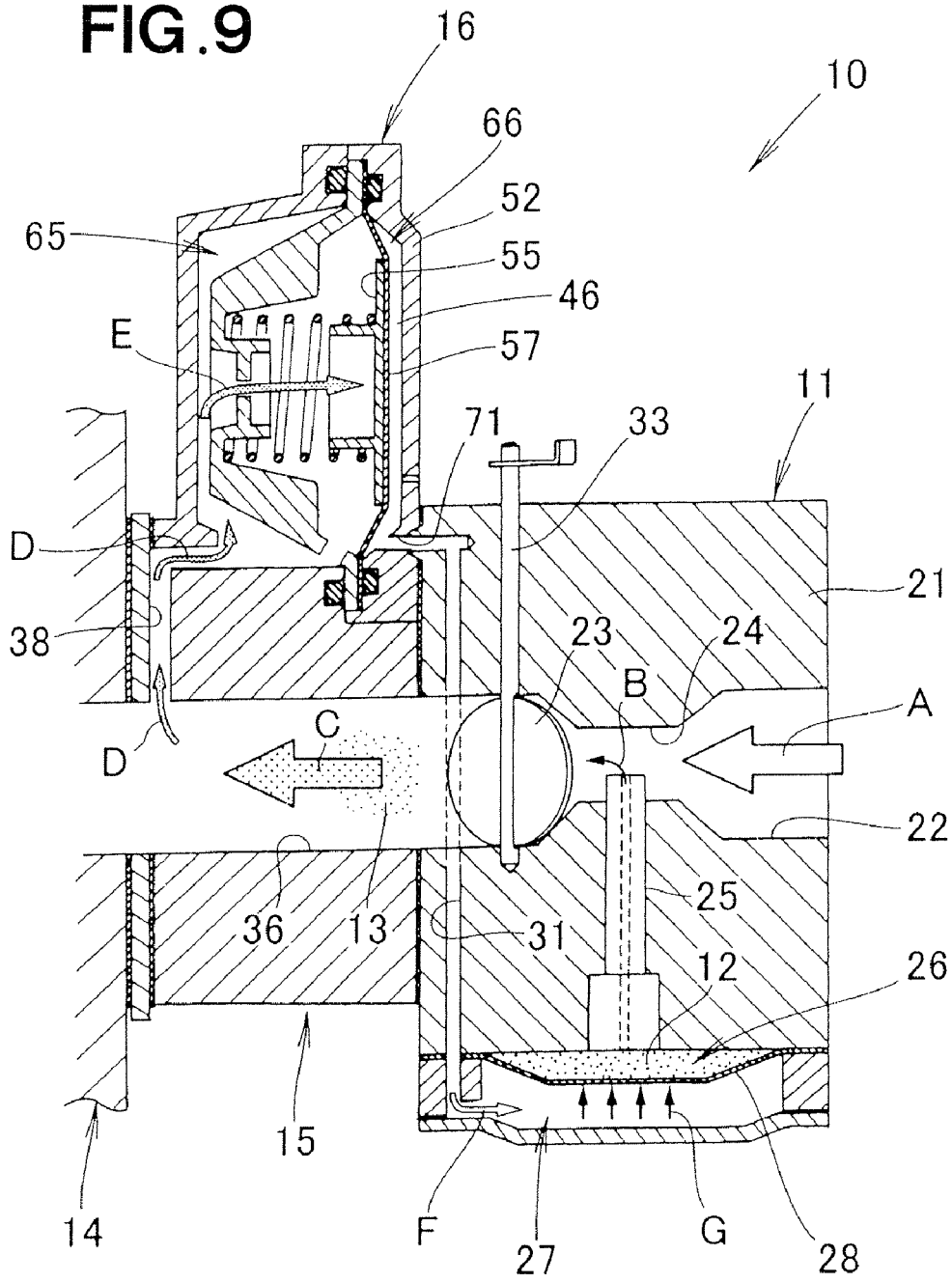
FIG. 9 is a view showing an example in which the fuel inside of the fuel booster pump of the fuel supply apparatus according to the present invention is returned to the air-fuel mixture supply channel.

As shown in FIG. 8, moving the pressure diaphragm 28 toward the fuel storage chamber 26 causes the fuel 12 in the fuel storage chamber 26 to be supplied in a temporarily increased amount to the Venturi part 24 via the fuel nozzle 25, as shown by arrow H. The fuel 12 contained in the air-fuel mixture 13 can thereby be temporarily increased in quantity and made to flow through the air-fuel mixture supply channel 36, as shown by arrow I. The air-fuel mixture 13 in which the amount of the fuel 12 is temporarily increased can thereby be fed to the engine 14, and the engine 14 can be prevented from being inadequately accelerated or stopped.

When the throttle valve 23 is maintained at a constant angle, the air-fuel mixture supply channel 36 is kept under negative pressure. Keeping the air-fuel mixture supply channel 36 under negative-pressure establishes a negative pressure in the negative-pressure chamber 65 of the fuel booster pump 16. The negative-pressure diaphragm 57 thereby moves toward the support member 54, as shown by arrow J, and the air in the pump chamber 66 is no longer forced into the pressure chamber 27. The engine 14 is thereby driven in a normal state in which there is no temporary increase in the amount of fuel 12 contained in the air-fuel mixture 13.

Next, the operation of returning the fuel in the fuel booster pump 16 of the engine fuel supply apparatus 10 to the air-fuel mixture channel 36 will be described with reference to the principle view of FIG. 9.

As described in FIG. 7, when the angle of the throttle valve 23 is increased and the vehicle is rapidly accelerated, a portion if the air-fuel mixture 13 is fed to the negative-pressure chamber 65 of the fuel booster pump 16. The fuel 12 contained in the air-fuel mixture 13 therefore accumulates in the bottom part 45*a* of the negative-pressure chamber 65 and inside the support member 54. It is believed that the air-fuel ratio of the air-fuel mixture 13 supplied to the engine 14 from the carburetor 11 is varied by the accumulation of the fuel 12 in the negative-pressure chamber 65. Variations in the air-fuel ratio of the air-fuel mixture 13 make it difficult to drive the engine 14 smoothly.

In view of this, the fuel booster pump 16 is disposed above the air-fuel mixture supply channel 36. Specifically, as shown in FIG. 2, the fuel booster pump 16 is disposed above and to the side of the air-fuel mixture channel 22 of the carburetor 11, that is, is offset toward the side part 11*a*. Also, the negative-pressure chamber channel 38 is extended toward the air-fuel mixture supply channel 36 from the bottom part 45*a* of the negative-pressure chamber 65. As shown in FIG. 4, the first negative-pressure chamber channel 41 of the negative-pressure chamber channel 38 is thereby extended downwards at an inclination angle θ toward the air-fuel mixture supply channel 36 from the negative-pressure chamber 65. When the air-fuel mixture 13 is fed to the negative-pressure chamber 65, and the fuel 12 is caused to drip in the bottom part 45*a* of the negative-pressure chamber 65, the fuel can thereby be returned to the air-fuel mixture supply channel 36 via the negative-pressure chamber channel 38, as shown by arrow K.

Furthermore, the fuel 12 dripped on the inside of the support member 54 is fed through the exhaust port 61 of the support member 54 to the bottom part 45*a*. As described above, the fuel 12 fed to the bottom part 45*a* is returned to the air-fuel mixture supply channel 36 via the negative-pressure chamber channel 38, as shown by arrow K. Variations in the air-fuel ratio of the air-fuel mixture 13 can thereby be suppressed and the engine 14 can be driven smoothly.

The negative-pressure chamber channel 38 is extended downwards toward the air-fuel mixture supply channel 36 from the negative-pressure chamber 65. Specifically, as shown in FIG. 4, the first negative-pressure chamber channel 41 of the negative-pressure chamber channel 38 extends linearly toward the air-fuel mixture supply channel 36 from the negative-pressure chamber 65. Linearly extending the negative-pressure chamber channel 38 (specifically, the first negative-pressure chamber channel 41) thus allows the fuel from the negative-pressure chamber 65 to be returned smoothly to the air-fuel mixture supply channel 36 via the negative-pressure chamber channel 38.

The above embodiment was described with reference to an example in which the fuel supply apparatus 10 was used for a liquid fuel; however, this example is nonlimiting, and application to a gaseous fuel can also be made.

In addition, the above embodiment was described with reference to an example in which the fuel booster pump 16 is disposed above the air-fuel mixture channel 22 and offset toward the side part 11*a*. However, the fuel booster pump 16 may also be disposed above the air-fuel mixture channel 22 without being offset toward the part.

The above embodiment was described with reference to an example in which the first negative-pressure chamber channel 41 is extended at an inclination angle θ, but this example is nonlimiting, and the first negative-pressure chamber channel 41 may also be extended directly upwards.

The above embodiment was described with reference to an example in which the first negative-pressure chamber channel 41 is extended linearly, but this example is nonlimiting, and the first negative-pressure chamber channel 41 may also be formed, for example, in a dogleg configuration so as to be convex on the bottom.

INDUSTRIAL APPLICABILITY

The present invention can be used in an engine fuel supply apparatus provided with a fuel booster pump for increasing the amount of fuel fed to the carburetor.

The invention claimed is:

1. A fuel supply apparatus for an engine, having a carburetor provided with a pressure diaphragm partitioning a fuel chamber and a pressure chamber, for increasing an amount of fuel drawn from the fuel chamber by applying pressure to the pressure chamber, the engine fuel supply apparatus comprising:

an insulator interposed between the carburetor and the engine, the insulator acting to block off heat from the engine and having an air-fuel mixture supply channel for feeding an air-fuel mixture mixed with the fuel in the carburetor to the engine;

a fuel booster pump incorporated in the insulator, the fuel booster pump having a pump chamber for applying pressure to the pressure chamber, and a negative-pressure chamber disposed adjacent to the pump chamber via a negative-pressure diaphragm;

a negative-pressure chamber channel formed in the insulator so as to provide communication between the negative-pressure chamber and the air-fuel mixture supply channel, the negative-pressure chamber channel introducing a portion of the air-fuel mixture from the air-fuel mixture supply channel into the negative-pressure chamber; and a pump chamber channel formed in the body of the carburetor so as to provide communication between the pump chamber and the pressure chamber, the pump chamber channel introducing air from the pump chamber into the pressure chamber.

2. The engine fuel supply apparatus of claim 1, wherein the fuel booster pump is provided above the air-fuel mixture supply channel, and the negative-pressure chamber channel extends upwards toward the negative-pressure chamber from the air-fuel mixture supply channel.

3. A fuel supply apparatus for an engine, having a carburetor provided with a pressure diaphragm partitioning a fuel chamber and a pressure chamber, for increasing an amount of fuel drawn from the fuel chamber by applying pressure to the pressure chamber, the engine fuel supply apparatus comprising:

an insulator interposed between the carburetor and the engine, the insulator acting to block off heat from the engine and having an air-fuel mixture supply channel for feeding an air-fuel mixture mixed with the fuel in the carburetor to the engine;

a fuel booster pump incorporated in the insulator and disposed above the air-fuel mixture supply channel, the fuel booster pump having a pump chamber for applying pressure to the pressure chamber, and a negative-pressure chamber disposed adjacent to the pump chamber via a negative-pressure diaphragm; and a channel extending downwards toward the air-fuel mixture supply channel from the bottom part of the negative-pressure chamber, the channel introducing a portion of the air-fuel mixture from the air-fuel mixture supply channel into the negative-pressure chamber.

* * * * *